US007614864B2

(12) United States Patent
Zikeli et al.

(10) Patent No.: US 7,614,864 B2
(45) Date of Patent: Nov. 10, 2009

(54) ERGONOMIC SPINNING SYSTEM

(76) Inventors: Stefan Zikeli, Schacha 14, 4844 Regau (AT); Friedrich Ecker, St. Anna Str. 10, 4850 Timelkam (AT)

( * ) Notice: Subject to any disclaimer, the term of this patent is extended or adjusted under 35 U.S.C. 154(b) by 517 days.

(21) Appl. No.: 10/900,518

(22) Filed: Jul. 28, 2004

(65) Prior Publication Data

US 2005/0048151 A1 Mar. 3, 2005

Related U.S. Application Data

(63) Continuation of application No. PCT/EP02/12593, filed on Nov. 11, 2002.

(30) Foreign Application Priority Data

Jan. 28, 2002 (DE) ..... 102 04 381

(51) Int. Cl.
*B29C 47/08* (2006.01)

(52) U.S. Cl. ..... 425/71; 425/72.2

(58) Field of Classification Search ..... 425/71, 425/382.2, 173, 72.2; 264/40.1, 178 F, 211.14, 264/203

See application file for complete search history.

(56) References Cited

U.S. PATENT DOCUMENTS 1,655,433 A 1/1928 Morris
1,765,883 A 6/1930 Ruschke
2,179,181 A 11/1939 Graenacher et al.
2,518,827 A 8/1950 Smith
2,829,891 A * 4/1958 Ludwig ..... 482/146
3,061,402 A 10/1962 Sanders
3,404,698 A 10/1968 Rouse
3,407,784 A 10/1968 Hitt et al.

(Continued)

FOREIGN PATENT DOCUMENTS

AT 395 724 2/1993

(Continued)

OTHER PUBLICATIONS

International Search Report for International Application No. PCT/EP03/02946 Issued on Jul. 29, 2003.

(Continued)

*Primary Examiner*—Yogendra Gupta
*Assistant Examiner*—Emmanuel S Luk
(74) *Attorney, Agent, or Firm*—Michael Best & Friedrich LLP

(57) ABSTRACT

The invention relates to a system for producing endless molded bodies from a molding compound. For producing the endless molded bodies, spinning means are used comprising an extrusion head through which the molding compound is extruded to form endless molded bodies, a precipitating bath containing a precipitant, and an air gap between the extrusion head and the precipitating bath. After extrusion, the endless molded bodies are first passed through the air gap, and then through the precipitating bath. For facilitating control of the system, it is provided in accordance with the invention that the system comprises a control area arranged in front of the spinning means and accessible by the operating staff, and that the air gap is arranged freely visibly in a height freely defined by a central vision range of an operator standing upright in the staying area and looking substantially in a horizontal direction.

37 Claims, 4 Drawing Sheets

U.S. PATENT DOCUMENTS

| | | | | | |
|---|---|---|---|---|---|
| 3,628,321 | A | | 12/1971 | Schwartz | |
| 3,924,984 | A | | 12/1975 | Giacobazzi | |
| 3,932,576 | A | | 1/1976 | Patel | |
| 4,033,742 | A | | 7/1977 | Nichols et al. | |
| 4,043,718 | A | * | 8/1977 | Takenaka et al. | 425/72.2 |
| 4,142,913 | A | | 3/1979 | McCorsley, III et al. | |
| 4,144,080 | A | | 3/1979 | McCorsley, III et al. | |
| 4,211,574 | A | | 7/1980 | McCorsley, III et al. | |
| 4,219,040 | A | | 8/1980 | Fallon et al. | |
| 4,246,221 | A | | 1/1981 | McCorsley, III | |
| 4,261,941 | A | | 4/1981 | Sherman et al. | |
| 4,261,943 | A | * | 4/1981 | McCorsley, III | 264/136 |
| 4,263,929 | A | | 4/1981 | Kearney | |
| 4,416,698 | A | | 11/1983 | McCorsley, III | |
| 4,425,293 | A | * | 1/1984 | Vassilatos | 264/178 F |
| 4,477,951 | A | | 10/1984 | Geyer, Jr. et al. | |
| 4,529,368 | A | | 7/1985 | Makansi | |
| 4,641,404 | A | | 2/1987 | Seydel et al. | |
| 4,713,290 | A | * | 12/1987 | Kwon et al. | 428/364 |
| 4,869,860 | A | | 9/1989 | Lewis, Jr. | |
| 4,960,041 | A | | 10/1990 | Kiser | |
| 5,191,990 | A | | 3/1993 | Fritts | |
| 5,234,651 | A | * | 8/1993 | Kawai | 264/184 |
| 5,252,284 | A | * | 10/1993 | Jurkovic et al. | 264/187 |
| 5,262,099 | A | * | 11/1993 | Adams et al. | 264/474 |
| 5,275,545 | A | * | 1/1994 | Ohyanagi et al. | 425/73 |
| 5,362,430 | A | * | 11/1994 | Herold et al. | 264/103 |
| 5,518,670 | A | * | 5/1996 | Budenbender et al. | 264/28 |
| 5,607,639 | A | | 3/1997 | Zikeli et al. | |
| 5,639,484 | A | | 6/1997 | White et al. | |
| 5,658,524 | A | * | 8/1997 | Portnoy et al. | 264/559 |
| 5,792,399 | A | | 8/1998 | Meister et al. | |
| 5,868,985 | A | | 2/1999 | Frischmann | |
| 5,942,327 | A | | 8/1999 | Budgell et al. | |
| 5,968,434 | A | * | 10/1999 | Zikeli et al. | 264/187 |
| 5,984,655 | A | * | 11/1999 | Schwenninger et al. | 425/71 |
| 6,036,895 | A | * | 3/2000 | Budenbender et al. | 264/28 |
| 6,117,379 | A | | 9/2000 | Haynes et al. | |
| 6,173,767 | B1 | | 1/2001 | Kennon | |
| 6,258,406 | B1 | | 7/2001 | Enders et al. | |
| 6,706,224 | B2 | | 3/2004 | Firgo et al. | |
| 6,755,633 | B2 | | 6/2004 | Miller | |
| 7,115,187 | B1 | | 10/2006 | Bauer et al. | |
| 2002/0025433 | A1 | | 2/2002 | Chang et al. | |
| 2002/0086072 | A1 | | 7/2002 | Allen et al. | |
| 2003/0025252 | A1 | | 2/2003 | Sealey et al. | |
| 2003/0141251 | A1 | * | 7/2003 | Ji et al. | 210/653 |
| 2004/0081905 | A1 | | 4/2004 | Moribe et al. | |
| 2005/0035487 | A1 | | 2/2005 | Zikeli et al. | |
| 2005/0051210 | A1 | | 3/2005 | Zikeli et al. | |
| 2005/0220916 | A1 | | 10/2005 | Zikeli et al. | |
| 2006/0055078 | A1 | | 3/2006 | Zikeli et al. | |
| 2006/0083918 | A1 | | 4/2006 | Zikeli et al. | |
| 2006/0144062 | A1 | | 7/2006 | Zikeli et al. | |

FOREIGN PATENT DOCUMENTS

| | | | |
|---|---|---|---|
| DE | 218 121 | | 1/1908 |
| DE | 858 005 | C | 12/1952 |
| DE | 2 014 828 | | 10/1970 |
| DE | 20 14 828 | | 10/1970 |
| DE | 2011493 | | 10/1970 |
| DE | 2732012 | | 1/1978 |
| DE | 36 11 947 | | 10/1987 |
| DE | 42 19 658 | | 12/1993 |
| DE | 4306925 | | 9/1994 |
| DE | 4 309 416 | | 10/1994 |
| DE | 43 122 19 | | 10/1994 |
| DE | 44 09 609 | | 10/1994 |
| DE | 44 19 441 | | 12/1995 |
| DE | 44 26 966 | | 2/1996 |
| DE | 4439149 | | 5/1996 |
| DE | 44 19 440 | | 6/1996 |
| DE | 295 04 127 | | 8/1996 |
| DE | 19504316 | | 8/1996 |
| DE | 195 11 151 | | 10/1996 |
| DE | 19 753 806 | | 6/1998 |
| DE | 19 717 257 | | 10/1998 |
| DE | 197 21 609 | | 11/1998 |
| DE | 19837210 | | 11/1999 |
| DE | 69425098 | | 7/2000 |
| DE | 19 915 235 | | 10/2000 |
| DE | 19924508 | | 11/2000 |
| DE | 100 23 391 | | 3/2001 |
| DE | 100 37 923 | | 3/2001 |
| DE | 100 37 923 | A | 3/2001 |
| DE | 100 16 307 | | 10/2001 |
| DE | 100 19 660 | | 11/2001 |
| DE | 10029044 | | 1/2002 |
| DE | 100 60 877 | | 7/2002 |
| DE | 100 60 879 | | 7/2002 |
| DE | 10 200 405 | | 8/2002 |
| DE | 10206089 | | 8/2002 |
| DE | 102 23 268 | | 1/2003 |
| DE | 10 200 406 | | 7/2003 |
| DE | 10 204 381 | | 8/2003 |
| DE | 69913117 | | 8/2004 |
| DE | 10314878 | | 10/2004 |
| EP | 0 172 001 | | 2/1986 |
| EP | 0356419 | | 2/1990 |
| EP | 04 94 851 | | 7/1992 |
| EP | 584318 | | 3/1994 |
| EP | 0 626 198 | | 11/1994 |
| EP | 0641877 | | 3/1995 |
| EP | 0 662 264 | | 7/1995 |
| EP | 0662204 | | 7/1995 |
| EP | 0 789 822 | | 8/1997 |
| EP | 0818469 | | 1/1998 |
| EP | 0 853 146 | | 7/1998 |
| EP | 0789790 | | 1/1999 |
| GB | 1 311 146 | | 3/1973 |
| GB | 2 007 147 | | 5/1979 |
| GB | 1 583 265 | | 1/1981 |
| JP | 59-228012 | | 12/1984 |
| JP | 64-01052809 | | 2/1989 |
| JP | 03-076822 | | 4/1991 |
| WO | WO 93/19230 | | 9/1993 |
| WO | 94/06530 | | 3/1994 |
| WO | WO 94/08162 | | 4/1994 |
| WO | WO 94/18983 | | 9/1994 |
| WO | WO 94/20656 | | 9/1994 |
| WO | 94/28210 | | 12/1994 |
| WO | 94/28215 | | 12/1994 |
| WO | 94/28219 | | 12/1994 |
| WO | WO 94/28218 | | 12/1994 |
| WO | WO 95/01470 | | 1/1995 |
| WO | WO 95/01473 | | 1/1995 |
| WO | WO 95/04173 | | 2/1995 |
| WO | WO 95/05173 | | 2/1995 |
| WO | 95/08010 | | 3/1995 |
| WO | 95/11261 | | 4/1995 |
| WO | WO 96/07777 | | 3/1996 |
| WO | WO 96 187 60 | | 6/1996 |
| WO | WO 96/17118 | | 6/1996 |
| WO | WO 96/20300 | | 7/1996 |
| WO | WO 96/21758 | | 7/1996 |
| WO | 96/27035 | | 9/1996 |
| WO | 96/33221 | | 10/1996 |
| WO | 96/33934 | | 10/1996 |
| WO | WO 96/30566 | | 10/1996 |
| WO | 96/38625 | | 12/1996 |
| WO | WO 97/33020 | | 9/1997 |
| WO | 98/05702 | | 2/1998 |
| WO | WO 98/18983 | | 5/1998 |

| | | |
|---|---|---|
| WO | WO 98/19230 | 5/1998 |
| WO | WO 98/28218 | 7/1998 |
| WO | WO 99/00185 | 1/1999 |
| WO | 99/16948 | 4/1999 |
| WO | WO 00/06813 | 2/2000 |
| WO | 01/27161 | 4/2001 |
| WO | WO 01/58960 | 8/2001 |
| WO | 01/70819 | 9/2001 |
| WO | WO 01/68958 | 9/2001 |
| WO | WO 01/74906 | 10/2001 |
| WO | 01/88232 | 11/2001 |
| WO | 01/88419 | 11/2001 |
| WO | WO 03/057951 | 7/2003 |
| WO | WO 03/057952 | 7/2003 |
| WO | WO 03/069200 | 8/2003 |
| WO | WO 03/080906 | 10/2003 |
| WO | WO 03/100140 | 12/2003 |
| WO | WO 2004/088010 | 10/2004 |
| WO | 2005/113868 | 12/2005 |
| WO | 2005/113869 | 12/2005 |
| WO | 2005/113870 | 12/2005 |

OTHER PUBLICATIONS

Taschenbuch für Heizung- und Klimatechnik 68, Auflage 1997/1998, Recknagel-Sprenger-Schramek, ISBN 3-486-26214-9, pp. 1073, 1074, 1247, 1248, 1438, 1613, 1614.

"Was Ist Neu an Den Neuen Fasern Der Gattung Lyocell". (What is new in the New Fibres of the Lyocell Type?), Lenzinger Berichte (Lenzinger Reports), Sep. 1994, pp. 37-40.

"Strukturbildung von Cellulosefasern Aus Aminoxidlösungen", (Structure Formation of Cellulose Fibres from Amine Oxide Solutions), Lenzinger Berichte (Lenzinger Reports), Sep. 1994, pp. 31-35.

Jing, Y., "To improve the quality of feeding air of a spinning air conditioner," Jinshan Oil and Chemical Fibers (2000) 3:35-38.

Buijtenhuijs, F.A. et al., "The degradation and stabilization of cellulose dissolved in N-methylmorpholine-n-oxide (NMMNO)," Papier 40:12 (1986) 615-619.

Brand, O. et al., "Micromachined viscosity sensor for real-time polymerization monitoring," 1997 International Conference on Solid-State Sensors and Actuators, Chicago, Illinois, Jun. 16-19, 1997 (4 pages).

* cited by examiner

ERGONOMIC SPINNING SYSTEM

This patent application is a continuation of International Application No. PCT/EP02/12593, filed on Nov. 11, 2002, which claims the foreign priority of German Patent Application No. 102 04 381.7 filed on Jan. 28, 2002. The entire disclosure of each prior application is considered as being part of the disclosure of the accompanying application and is hereby incorporated by reference. Priority is hereby claimed to each of these application.

FIELD OF THE INVENTION

The invention relates to a system for the production of endless molded bodies from a molding compound such as a spinning solution containing water, cellulose and tertiary amine oxide, with spinning means comprising an extrusion head, through which the molding compound is extruded to form endless molded body, a precipitating bath containing a precipitating bath solution, and an air gap arranged between the extrusion head and the precipitating bath, wherein the endless molded bodies are first passed through the air gap and then through the precipitating bath.

BACKGROUND

Systems of this type are known, for example, from WO 95/01470, WO 94/28218 and WO 98/18983. Said documents relate to the production of lyocell fibers and corresponding endless molded bodies from a spinning solution substantially containing water, cellulose and tertiary amine oxide. Endless molded bodies from such a spinning solution are substantially produced in the three working steps extrusion, drafting and precipitation.

SUMMARY

For the extrusion, the heated spinning solution is passed through extrusion openings in the extrusion heads and extruded to form endless molded bodies. The extrusion openings are directly followed by an air gap in which a tensile force acts on the endless molded bodies and drafts the same. The thickness of the endless molded bodies, e.g. the fiber titer in the case of textile fibers, is adjusted by the tensile force. Moreover, the molecules in the endless molded bodies are aligned under the influence of the tensile force thereby increasing the mechanical stability thereof. The solvent is precipitated in the precipitating bath.

One problem inherent in the production of endless molded bodies from a spinning solution containing water, cellulose and tertiary amine oxide is that the surface tack of the endless molded bodies is very high after the extrusion. Upon touching each other in the air gap, the endless molded bodies, therefore, tend to immediately stick to each other, which entails tears of individual endless molded bodies or thickenings in the finished endless molded bodies. If tears occur, the extrusion process has to be stopped and restarted. Undrafted parts result in a reduced fiber quality and in increased waste.

Some solutions for reducing the surface tack of the endless molded bodies in the air gap are proposed in the prior art. A largely used solution resides in cooling the endless molded bodies in the air gap with an air stream immediately after they are discharged from the extrusion openings. The cooled surface of the endless molded bodies has a lower surface tack, so that the risk of conglutinations in the air gap after the air quenching is reduced.

As is described in WO 95/01470 and WO 95/04173, the extrusion openings may be arranged on an annulus-shaped surface, through the center of which the radially outwardly guided cooling wall jet is passed. Given such an annular arrangement, however, problems occur when the endless molded bodies immerse into the precipitating bath.

Therefore, rectangular spinnerets are used instead of annular die arrangements, as are described in WO 94/28218 and WO 98/18983. In rectangular spinnerets the extrusion openings are distributed over a substantially rectangular surface, and the cool air quenching takes place on one side of the rectangle, typically on the long side, and through the rows of the endless molded bodies.

Even though it is possible on the basis of the aforementioned solutions to reduce the risk of conglutinations in the air gap portion, this risk cannot completely be precluded. If conglutinations occur, the extrusion process must still be stopped and the spinning has to be started anew. Furthermore, the endless molded bodies have to be threaded anew into the various apparatus leading them to the different ongoing processing stages.

The prior art fails to show any solutions, however, which allow a fast detection of malfunctions in the extrusion process by the operating staff, and an easy maintenance and adjustment of the extrusion process.

The present invention is, therefore, based on the object to provide a constructively simple system which facilitates the monitoring of the extrusion process.

According to the invention, this object is provided in that the system comprises a control area, which is arranged in front of the spinning means and accessible by the operating staff, and in that the air gap is arranged in a freely visible way at a height defined by the central vision area of an operator looking in a substantially horizontal direction and standing or walking upright in the staying area.

This solution allows an operator staying in the control area the easy observation of the spinning process. The control area may be a corridor in which the operating staff makes check patrols. By arranging the air gap in the central vision area of an operator substantially standing or walking upright in the control area, the operator can immediately see the air gap when walking past the spinning system, and can immediately recognize breaks or other problems during the extrusion process. Specifically, the operating staff no longer has to bend down for observing the air gap, as was previously necessary.

For allowing a fast detection by the operating staff standing in the control area, the spinning means are arranged within the central vision range, preferably at an angle of at most ±15° about the horizontal line on the eye-level of the operator. The perception and the optical resolution of a human being is especially sharp in the central vision range, and details can be detected especially well in this range. Preferably, the central vision range of a person looking in a horizontal direction extends from the horizontal line downwardly by an angle of 15°.

According to another advantageous embodiment, the spinning means can moreover comprise bundling means, by which the endless molded bodies are formed, for instance, to a fiber bundle. For also allowing the operation of the bundling means by operating staff in the control area, the bundling means, too, is disposed within the system as to be freely visible by a person, in the central vision range thereof, substantially standing upright in the control area and looking in a horizontal direction. The bundling means may specifically be arranged approximately on the eye-level of the operating staff standing in the control area, so that the bundling means can be monitored together with the air gap without requiring the operating staff to perform great body movements.

For facilitating the threading of the endless molded bodies on the bundling means after an interruption, e.g. caused by a periodically performed exchange of the spinning nozzles or filters, it is provided according to another advantageous embodiment to dispose the bundling means in the system between the extrusion head and the control area in a freely accessible manner.

The operation of the bundling element and the monitoring thereof is particularly facilitated, if the bundling means is arranged outside the precipitating bath, preferably above the precipitating bath. The arrangement outside the precipitant facilitates the threading of endless molded bodies when the spinning is started. If the bundling means is arranged above the precipitating bath, maintenance no longer has to be carried out both underneath and above the precipitating bath, as is common with conventional systems comprising spinning funnels, which is tiring for and hard to overlook by the operating staff, and, therefore, also prone to errors.

According to another advantageous embodiment, the spinning means can also comprise a re-directing means which is arranged in the precipitating bath and is freely visible by a person standing in the control area and looking in a substantially horizontal direction and by which the endless molded bodies are re-directed in the direction of the surface of the precipitating bath. For this purpose, the precipitating bath may be configured correspondingly on its side facing the control area, e.g. by comprising a slope, so that the redirecting means can be overlooked by the operating staff through the surface of the precipitating bath, and/or by comprising a transparent front through which the re-directing means can be seen.

According to another advantageous embodiment, a re-directing means may be formed by the edge of the precipitating bath, preferably by the side of the precipitating bath facing the operating staff. This embodiment is, per se, advantageous as, by the re-direction at the edge of the precipitating bath, the precipitant is guided out of the endless molded bodies and then flows back along the edge of the precipitating bath into the same without additional measures. According to an improved embodiment, the edge may comprise a rounded off portion for the smooth re-direction of the endless molded bodies. Furthermore, for fixing the endless molded bodies, the edge of the precipitating bath may be slightly deepened or recessed in the re-direction area, compared to the rest of the edge. The endless molded bodies are guided in said deepened edge without being capable of escaping laterally.

The control of the extrusion process by the operating staff staying in the control area is particularly more easy if the extrusion openings of an extrusion head are arranged substantially along a rectangular surface and the long side of the rectangle extends substantially parallel to the control area or, respectively, to a front side of the machine. Given this arrangement, the operating staff is able to control the highest possible number of endless molded bodies in the air gap. The rectangular surface on which the extrusion openings are disposed preferably comprises a high side aspect ratio of at least 3:1, preferably of at least 10:1.

According to another advantageous embodiment, the endless molded bodies may be conducted to the re-directing means in the form of a substantially plane curtain whereof the long side extends parallel to the control area so as to facilitate the control of the redirection process by the operating staff.

By the arrangement of the spinning means and, especially, of the entire extrusion zone from the extrusion openings to the re-directing means in the central vision range of a person standing in the control area and looking substantially in a horizontal direction, i.e. approximately on the eye-level thereof, the manual handling of the spinning means may be more difficult in case of repair or when the spinning is started, due to the high arrangement, as the arm muscles tire more quickly when working with held up arms. Therefore, it is provided according to an advantageous embodiment that the system comprises, in addition to the control area, a maintenance area for maintaining the spinning means and for manually handling the spinning means, which is disposed between the control area and the spinning means within the reach of a person standing upright in the maintenance area from the spinning means. The work with the spinning means is facilitated in that the maintenance area is arranged on a height different from that of the control area. The height of the maintenance area is dimensioned such that the spinning means are arranged substantially underneath the eye-level of a person standing upright in the maintenance area in the reaching area of this person. The reaching area corresponds to the radius of action of a stretched out arm, i.e. the arm length, measured about the shoulder of a representative operator standing substantially upright in the maintenance area.

The extrusion zone of the system taken or, respectively, defined by the spinning means may be accessed by operating staff in the maintenance area in an ergonomically favorable manner, if, according to an advantageous embodiment, the distance of the different spinning means from one another is not more than 80 cm, preferably not more than 50 cm. Furthermore, it is an advantage, if all spinning means are arranged above the bottom of the precipitating bath, so that the precipitating bath is not an obstacle during maintenance, around which works have to be performed.

For allowing a particularly ergonomic posture of the operating staff when working with the spinning means, the difference in height between the maintenance area and the control area may, according to an improved embodiment, correspond to the difference between a shoulder level and an eye-level of the operating staff.

When working with the spinning means, it is a drawback if individual spinning means are masked or covered by devices disposed in front thereof, or if they are accessible only after the removal of other devices. For preventing the same, it may be provided in another improved embodiment that the spinning means are arranged to be freely accessible by a person standing upright in the maintenance area. In other words, the spinning means do not mask or cover each other.

The spinning means may also comprise an adjusting means for the air gap with a handle, being arranged so as to be freely accessible by a person standing in the maintenance area. By means of the adjusting means for the air gap, the height of the air gap can be adapted to the respective spinning conditions by raising the precipitating bath or the extrusion head.

According to an improved embodiment, the system may also comprise a plurality of extrusion stations spaced from each other along the control area, wherein each extrusion station is provided with spinning means. Accordingly, in this embodiment, each extrusion station comprises an extrusion head, at least one re-directing means and least one bundling means. The system may especially be composed of individual extrusion stations so as to be extendable in a modular fashion.

In as far as reference was made to human physical dimensions in the preceding embodiments, e.g. the eye-level, the shoulder level and the reaching area, the dimensions of the average population representative of the operating staff are referred to. In Germany, such dimensions are, for example, set forth in DIN 33402. In view of the dimensions as indicated, especially the median, i.e. the $50^{th}$ percentile, is assumed, preferably on the basis of a population group aged between 16 and 60 or, alternatively, between 18 and 40. It should be noted that said dimensions may be different in individual countries and regions, and are, for example in the East Asian region, smaller than in Europe. In view of the eye-level defined in the patent document, especially a height between 135 and 175 cm, preferably of about 155 cm may be assumed.

BRIEF DESCRIPTION OF THE DRAWINGS

The invention will hereinafter be explained in more detail by means of two embodiments with reference to the drawings, wherein.

DETAILED DESCRIPTION

Figure 1:
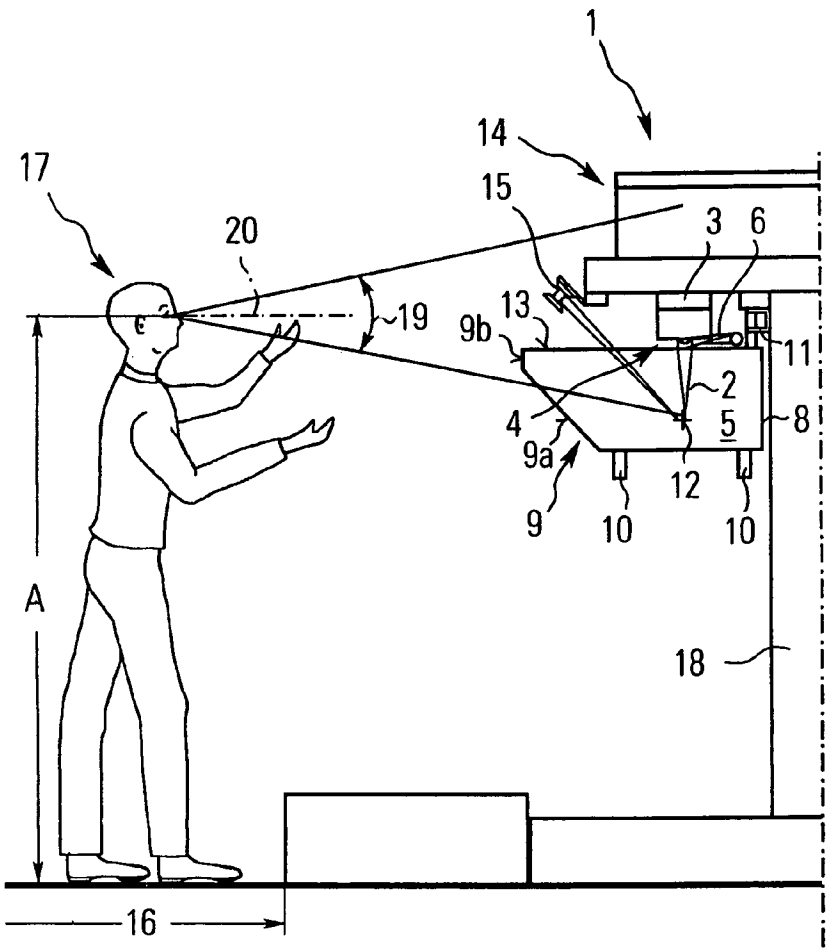
FIG. 1 shows a lateral view of an embodiment of a system according to the invention with an operator in a control area.

FIG. 1 shows one of several possible embodiments of a system 1 for producing endless molded bodies 2 from a molding compound. In the system 1 illustrated in FIG. 1, a spinning solution (not shown) containing water, cellulose and tertiary amine oxide is used for the production of the endless molded bodies 2. System 1 comprises an extrusion head 3 with extrusion openings (not shown), whereby the molding compound is extruded through the extrusion openings to form endless molded bodies 2.

The extruded endless molded bodies 2 are passed through an air gap 4 and a precipitating bath 5. An air quenching device 6 is arranged in the air gap 4, through which a quench air stream is passed onto the extruded endless molded bodies 2.

The precipitating bath 5 is filled with a precipitant, e.g. water, and comprises a trough-shaped container 8 with a transparent front 9 having a lower oblique part 9*a* expanding in an upward direction and an upper vertical part 9*b*.

Inlets and outlets 10 are disposed at the lower side of the precipitating bath 5. The length of the air gap 4 may be adjusted by means of a handle 11 above the precipitating bath 5, which forms part of an air gap adjusting means, for example by changing the height of the precipitating bath 5. Optionally, the adjustment of the air gap may also be effected by tilting the trough about a center of motion. A handle 11 for adjusting the pitch may likewise be disposed in this arrangement, at the position illustrated in FIG. 1.

A re-directing means 12, e.g. in the form of a roller, is arranged in the precipitating bath 5 or, respectively, in the precipitant. The re-directing means 12 re-directs the endless molded bodies 2 in the direction of a precipitating bath surface 13 and in the direction towards the front 14 of the system 1.

After the re-direction, the endless molded bodies 2 are supplied to a bundling means 15 arranged at the front of the system 1. The endless molded bodies, which, due to a rectangular arrangement of the extrusion openings in the extrusion head, enter into the precipitating bath 5 in the form of a plane curtain and are re-directed by the re-directing means 12 in the form of a plane curtain, are combined to form a thread or filament bundle by the bundling means and are passed on to processing steps not illustrated.

The bundling means 15 is constructed in a substantially roller-shaped fashion, with the axis of the roller extending obliquely against the horizontal line, so that a part of the roller surface faces towards the front 14.

System 1 moreover comprises a control area 16 extending at a distance of at most 2 m, preferably of at most 1 m to 1.5 m, in front of the front 14 of the machine and in a direction parallel to the front 14 of the machine. The control area can be accessed by the operating staff 17, and allows the operating staff in the control area to check the proper function of the system 1 by inspecting the same when walking by or when standing.

System 1 is configured such that, via a supporting means 18, the extrusion area, at least, however, the extrusion head and/or the air gap 4, is held at a level approximately corresponding to the eye-level A of an operator 17, whereby the operator 17 stands substantially upright in the control area, as is shown in FIG. 1. Hence, the extrusion area is positioned in a central vision range 19 of a person walking or standing upright in the control area 16.

The precipitating bath surface 13 is preferably arranged somewhat underneath the eye-level A of the operator 17, so that no or only a few reflections occur on the precipitating bath surface and a look may be cast into the filled precipitating bath 5 from the control area. Due to the pitch of the bundling means 15 as against the horizontal line, the operator 17 may easily control the correct bundling of the endless molded bodies 2 to a thread bundle. Through the transparent front 9 of the trough 8 of the precipitating bath 5, the operator 17 may monitor at the proper function of the re-directing means 12 from the control area, without having to perform a great deal of body movements.

The spinning means can designate any combination of the extrusion head 3, air gap 4, precipitating bath 5, re-directing means 12, bundling means 15 and air quenching device 6, and preferably includes the combination of all of said devices.

The central vision range extends approximately by 15° to both sides of a horizontal line 20 extending on the eye-level, preferably by 15° underneath the same, and is characterized, on one hand, by that portion of the retina of the eye of an operator 17 having the highest optical resolution and color resolution due to the highest rod density and, on the other hand, psychologically by particularly sharp perception.

For monitoring the air gap 4 more easily, the same is freely visible and not blocked by devices arranged between the operator 17 in the control area 16 and the air gap. An operator 17 designates a human being with the average physical body dimensions of a statistically representative population group.

Especially authoritative are, however, the dimensions of the $50^{th}$ percentile of a group of persons relevant for operators 17 of systems 1, as is, for instance, defined in DIN 33402. The air gap may especially be positioned at a height between 135 cm and 175 cm, the precipitating bath surface at a height of approximately 150 cm. Said dimensions may, however, vary in the individual regions. The eye-level or the length of an arm, for example, of average persons in Europe and Asia differ respectively.

Figure 2:
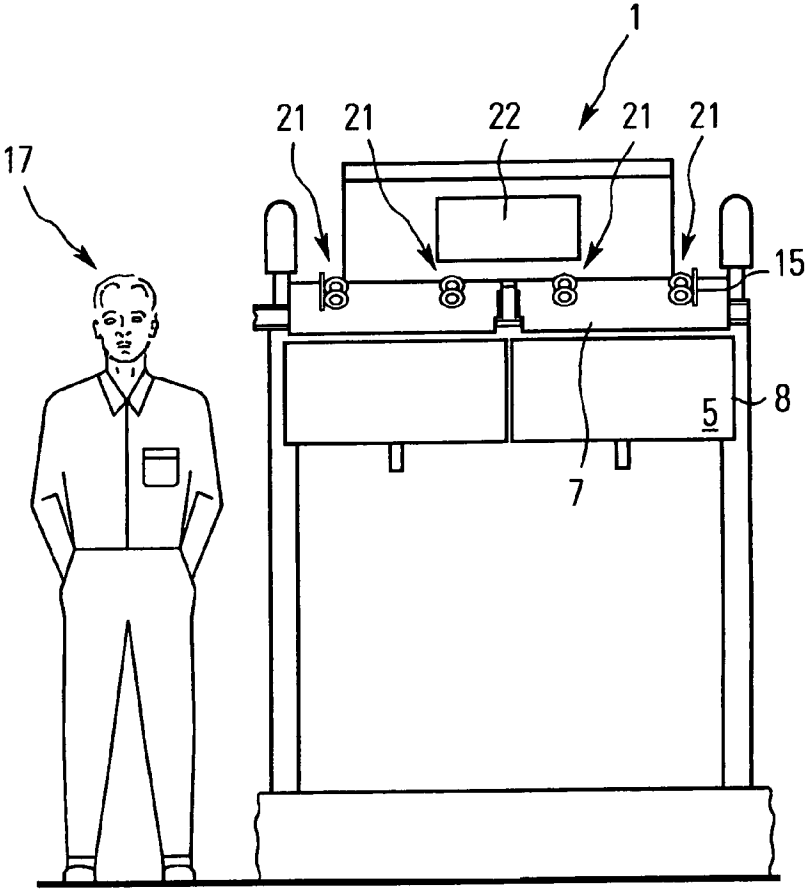
FIG. 2 shows the system of FIG. 1 in a front view from the control area.

FIG. 2 shows a view to the front 14 of the system seen by an operator 17 in the control area 16. For showing the relationships of the heights more clearly, the operator 17 is illustrated in the figure from the front. In FIG. 2, some of the reference numbers of FIG. 1 have been indicated again for explanatory purposes.

As can be seen in FIG. 2, system 1 consists of a plurality of extrusion stations 21. Merely for exemplary purposes, four extrusion stations 21 are illustrated in FIG. 2. The number of extrusion stations 21 may, however, also be smaller or larger.

Each extrusion station 21 is associated with an extrusion head 3 having extrusion openings in a rectangular arrangement, whereby the long side of the rectangle extends in parallel to the control area 16 and to the front 14 of the system 1. Furthermore, each extrusion station 21 comprises an air quenching device 6 (not shown in FIG. 2) as well as re-directing means 12.

Due to the modular structure, system 1 may be extended at any time. As is shown in FIG. 2, for instance, two extrusion stations 21 are allocated to each trough 8, so that the system according to FIG. 1 may optionally be extended.

Because of the alignment of the long side of the rectangular nozzles towards the control area 16, the largest possible number of extrusion bodies 2 is visible and controllable from the control area 16.

In addition, system 1 may comprise a viewing window 22, through which the person standing in the control area 16 can gain a view into the devices required for passing the molding compound to the extrusion head 3. The viewing window 22 may particularly also be arranged within a portion extending by 15° above the horizontal line on the eye-level of a person 17 walking or standing upright in the control area 16.

Figure 4:
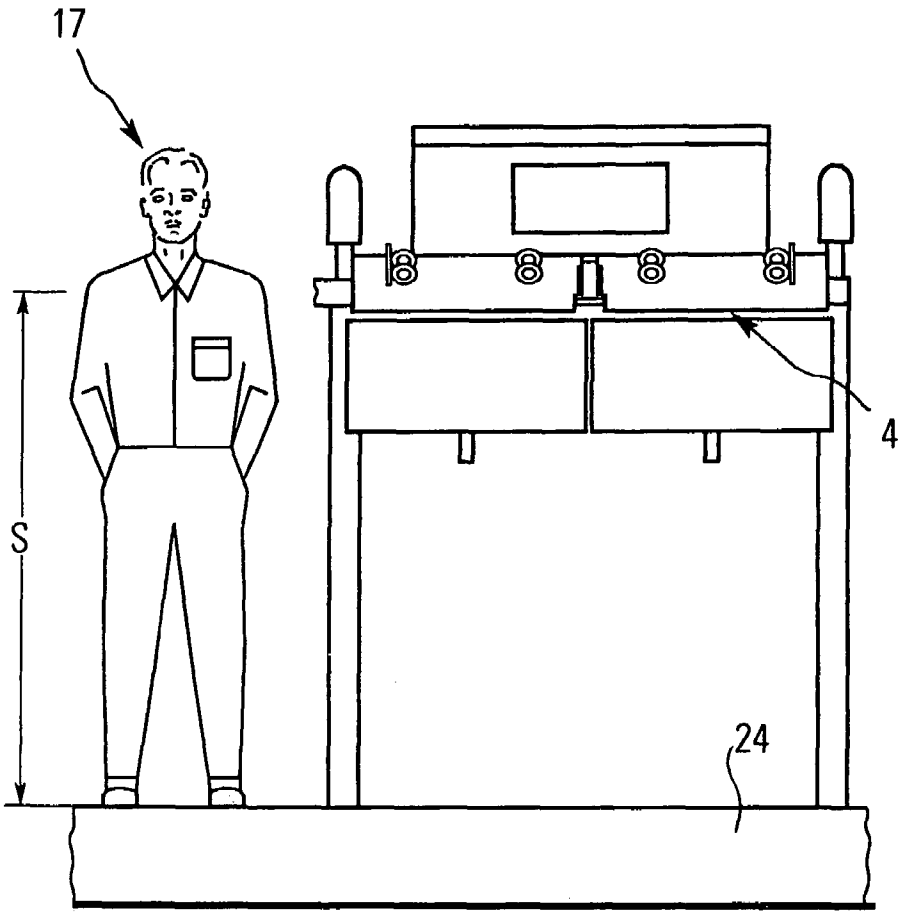
FIG. 4 shows the system of FIG. 1 in a front view from the control area.
Figure 3:
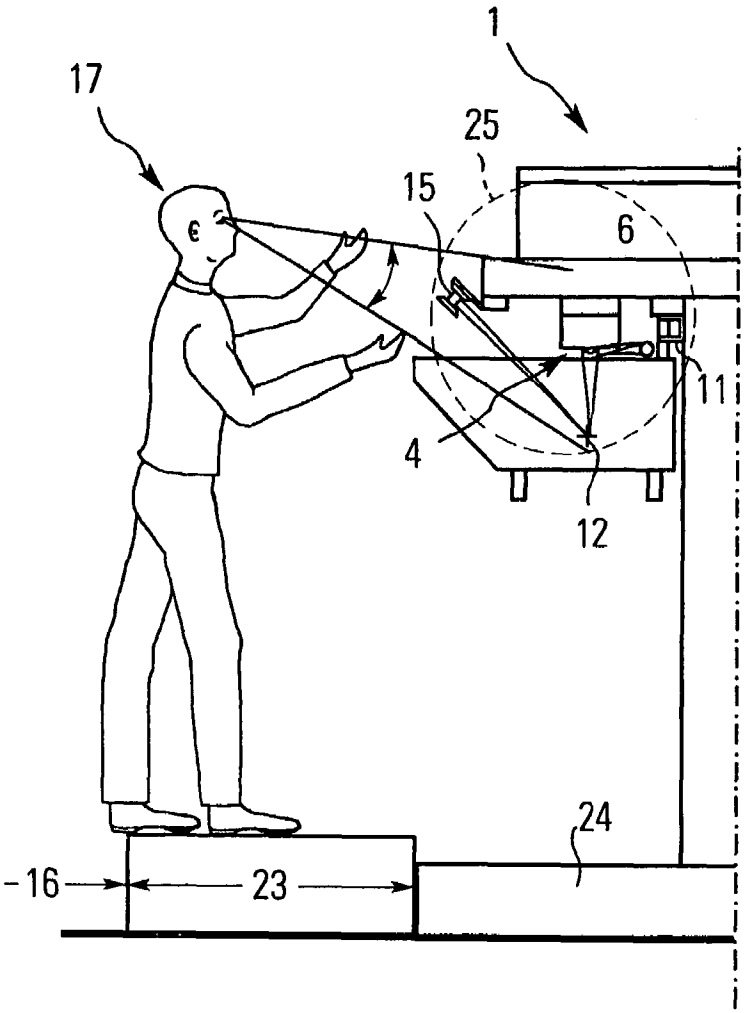
FIG. 3 shows a lateral view of the system of FIG. 1 with an operator in a maintenance area.

As is illustrated in FIGS. 3 and 4, system 1 may additionally comprise a maintenance area 23 the height of which is dimensioned such that the spinning means are within the reaching area of a person standing upright in the maintenance area 23, preferably within a range about and underneath the shoulder level S. Specifically, the maintenance area 23 is raised compared to the control area 16, e.g. by means of a platform 24, or may also be lowered. The difference in height between the maintenance area 23 and the control area 16 corresponds approximately to the difference between the typical eye-level A and the typical shoulder level of operators 17 in accordance with the aforementioned dimensioning rule, with reference to a representative average population. The difference in height may specifically range between 20 cm and 40 cm, preferably be around 25 cm.

As is illustrated in FIG. 3, the platform 24 is constructed such that the spinning means, or at least essential spinning means, are now within a reaching area 25 of an operator 17 standing on the platform 24 in the maintenance area. Thus, the operator 17 standing in the maintenance area 23 can access the extrusion area and perform maintenance works in an upright position substantially without changing his or her posture. By this embodiment, system 1 is ergonomically operable. Specifically, spinning means 15, 12, 4, 6, 7 and/or 11 are arranged to be freely accessible, so that they do not overlap seen from the location of a person standing in the maintenance area 23.

The access to the extrusion area is especially facilitated due to the fact that no spinning means is arranged further away than 50 cm from the maintenance area, particularly from the shoulder of a person standing upright in the maintenance area 23, or from the front 14 of the system 1. Moreover, the distance of the spinning means from each other is likewise at most 50 cm, and all spinning means are disposed above the bottom of the trough 8.

As can additionally be seen in FIG. 3, the spinning means are arranged such that they can freely be viewed by the operator 17 standing upright in the maintenance area 23 and are optically not overlapping. The spinning means are especially disposed such that they are arranged in a central vision range 19 of the operator 17 standing in the maintenance area 24 when the same bends down his or her head.

FIG. 4 shows a view of system 1 from the control area 16 to the front 14 of the system 1, whereby the operator 17 is illustrated to be standing on the platform 24. It can be recognized in FIG. 4 that the air gap 4 is arranged approximately at shoulder level, in FIG. 4 somewhat lower, so as to allow, starting out from the standing posture of the operator 17, an ergonomically favorable manual handling of the spinning means about the air gap 4 in a relaxed position.

It can, moreover, be recognized in FIG. 4 that the platform 24 may extend around the system 1 so as to provide for easier accessibility to the system 1 from all sides.

The skilled person will appreciate that the ergonomic arrangement of the spinning means according to the invention can also be used in systems 1 in which the redirecting means 12 is arranged outside the precipitating bath 5, e.g. in systems comprising spinning funnel arrangements.

Figure 5:
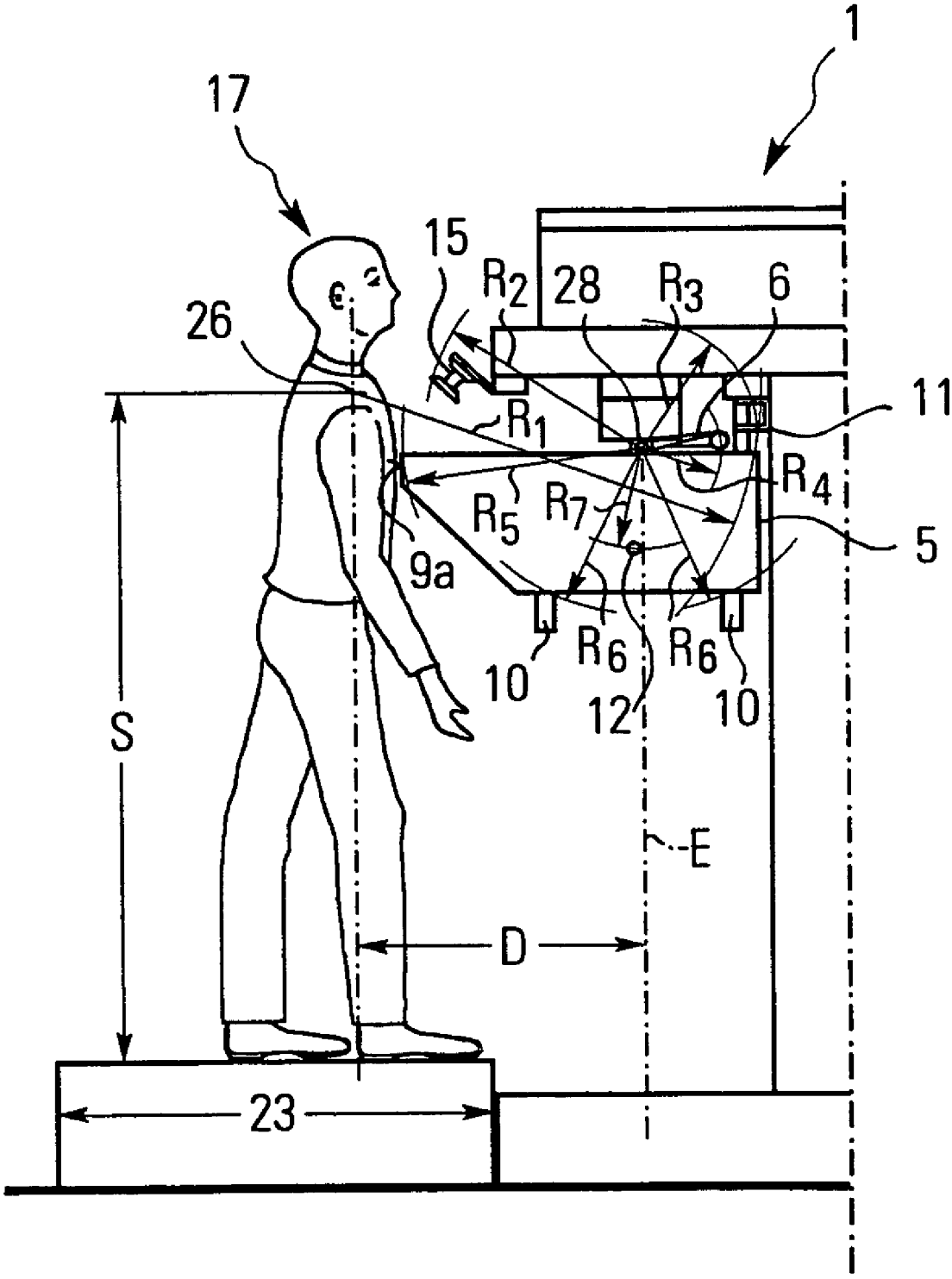
FIG. 5 shows the view of FIG. 3 with schematically indicated dimensions.

FIG. 5 schematically shows the distances of the spinning means from each other and the reaching area of a person standing in the maintenance area 23.

The shoulder 26 of the operator 17 is spaced away from the center plane E through the rows of extrusion openings by a distance D. Distance D is between 20 cm and 50 cm, preferably around 40 cm. As can be recognized in FIG. 5, the operator 17 can approach the system 1 only to a point where he interferes with or runs into the front 9*a* of the precipitating bath 5.

All spinning means are arranged within the reaching area of the operator standing in the maintenance area 23, i.e. at a distance $R_1$ from the shoulder 26, whereby the distance $R_1$ is preferably not larger than 70 cm. Preferably, the distance $R_1$ to the most remote spinning means from the shoulder 26 ranges between 35 cm and 45 cm. In the embodiment according to FIG. 5, the most remote spinning means are, for example, the inlet and the outlet 10 and the handle 11 for the air gap adjusting means.

If the intersecting point of plane E with the emergence or discharge plane of the endless molded bodies from the extrusion openings is used as the central point 28 of the spinning means, distance $R_2$ from this central point 28 to the bundling means 15 ranges between 25 cm and 40 cm, preferably between 35 cm and 40 cm. According to the embodiment shown in FIG. 5, the bundling means 15 is arranged above the central point 28 so as to allow an easier access to the air gap by the operator 17. The height of the bundling means 15 above the air gap may range between 10 cm and 20 cm, preferably is around 15 cm.

The distance $R_3$ to the handle 11 of the air gap adjusting means ranges between 15 cm and 25 cm.

Distance $R_4$ of the central point 28 in front of the adjusting means for the air quenching device 6 is preferably smaller than distance $R_3$.

Distance $R_5$ of the front edge of the precipitating bath 5 ranges between 20 cm and 50 cm, preferably is around 40 cm. Distances $R_6$ of the inlets and outlets 10 of the precipitating bath 5 range between 20 cm and 40 cm.

Distance $R_7$ of the re-directing means 12 from the central point 28 is less than 20 cm, preferably between 10 cm and 15 cm.

The above-described definition of the distances of the individual spinning means to each other and towards the shoulder 26 of the operator 17 allows an ergonomically favorable handling and maintenance of the spinning means by the operator 17 standing in an up-right position. The operator 17 can specifically access all spinning means, or at least the essential spinning means 4, 12, 15 from one position without changing position.

Figure 6:
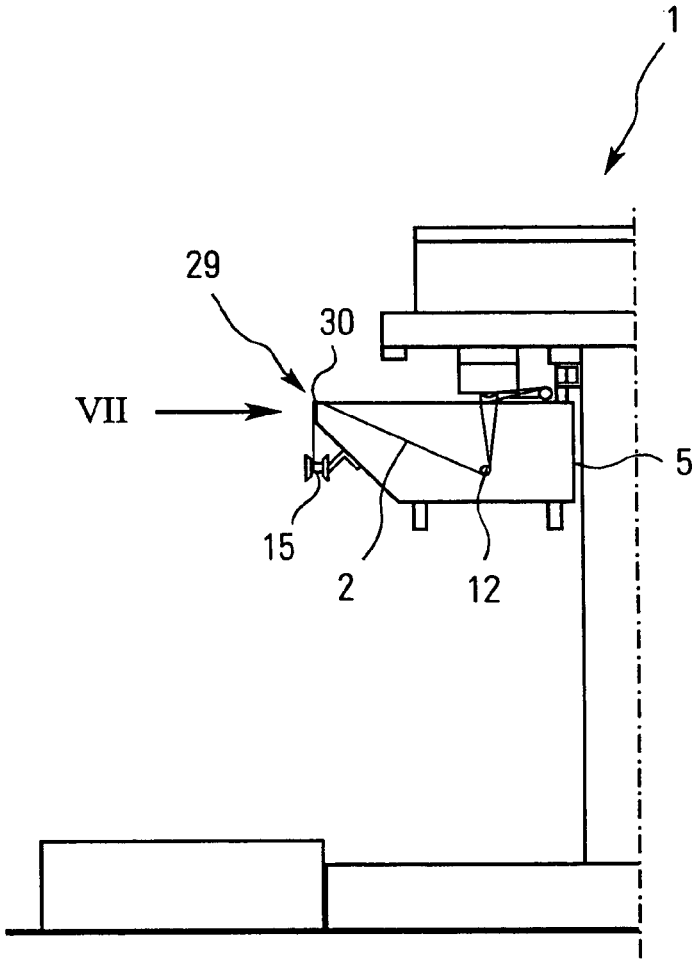
FIG. 6 shows a second embodiment in a view of FIG. 3 with schematically indicated dimensions.

FIG. 6 shows a second embodiment of a spinning system 1 according to the invention, whereby an additional re-direction point 29 is formed by the upper edge 30 of the precipitating bath 5. The re-directing means 12 re-directs the endless molded bodies 2 in the precipitating bath 5 in the direction of the upper edge 30, and from there in a downward direction towards the bundling means 15. Due to the re-direction, the precipitant is pressed out of the endless molded bodies 2 and flows back into the precipitating bath along front 90.

The embodiment shown in FIG. 6 with the deviation by the upper edge of the precipitating bath 5 is also advantageous by its own, independently of the ergonomic construction of system 1. The rest of the construction of system 1 according to the embodiment shown in FIG. 6 corresponds to the embodiments shown in FIGS. 1 to 5.

In the embodiment of FIG. 6, too, the bundling means 15 is easily accessible and immediately visible in the front portion of system 1.

Figure 7:
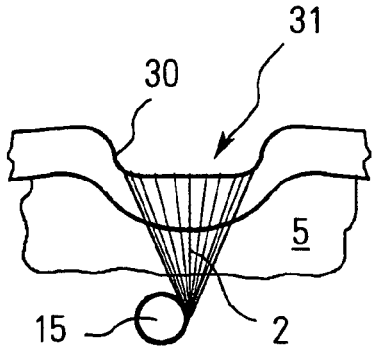
FIG. 7 shows a view along arrow VII of FIG. 6.

FIG. 7 shows a view along the arrow VII of FIG. 6.

As can be seen in FIG. 7, the upper edge 30 comprises a recess 31 which, as compared to the rest of the upper edge, is slightly lowered in a downward direction so as to allow a laterally stable passage of the endless molded bodies 2 towards the bundling means 15.

The upper edge 30 is radiused and made of a particularly smooth material, whereof the friction coefficient is only small when it is paired with the material of the endless molded bodies, e.g. special steel or coated special steel which may additionally be polished.

What is claimed is:

1. A system for producing endless molded bodies from a molding compound, the system comprising:

an extrusion head through which the molding compound is extruded to form endless molded bodies;

a precipitating bath containing a precipitant;

an air gap located between the extrusion head and the precipitating bath; and first area arranged in front of the extrusion head, the precipitating bath, and the air gap;

wherein the endless molded bodies are first passed through the air gap and then through the precipitating bath; and means for bundling positioned to be freely accessible between the extrusion head and the first area of the system, wherein the means for bundling is arranged outside and above the precipitating bath; and wherein the first area is accessible by an operating staff, the operating staff comprising an operator, and the air gap is positioned to be freely visible at a height defined by a central vision range of the operator standing or walking upright in the first area and looking substantially in a horizontal direction, the operator having average dimensions of a representative population group.

2. The system according to claim 1, wherein the central vision range extends approximately up to 15° above a horizontal line extending on an eye-level of the operator standing or walking in the first area.

3. The system according to claim 2, wherein the central vision range extends approximately up to 5° above the horizontal line extending on the eye-level of the operator standing or walking in the first area.

4. The system according to claim 1, wherein the central vision range extends by 15° underneath a horizontal line on an eye-level of the operator standing or walking in the first area.

5. The system according to claim 1, wherein the means for bundling is positioned to be freely visible in the system in the central vision range of the operator.

6. The system according to claim 1, wherein the means for bundling is arranged at a front of the system.

7. The system according to claim 1, further comprising a re-directing means by which the endless molded bodies are re-directed in a direction of a surface of the precipitating bath, wherein the re-directing means is positioned to be freely visible in the precipitating bath in the central vision range of the operator standing in the first area.

8. The system according to claim 1, wherein the extrusion head comprises a plurality of extrusion openings arranged on a rectangular surface, and wherein a long side of the rectangular surface faces towards the first area.

9. The system according to claim 7, wherein the endless molded bodies are passed to the re-directing means substantially in the form of a plane curtain, and wherein a long side of the plane curtain of endless molded bodies faces towards the first area.

10. The system according to claim 1, further comprising a second area for manual operation of the system, the second area located between the first area and the extrusion head and the precipitating bath, and positioned at a reaching distance of 50 cm or less from the extrusion head and the precipitating bath.

11. The system according to claim 10, wherein the second area is raised with respect to the first area to define a difference in height between the second area and the first area.

12. The system according to claim 11, wherein the difference in height between the second area and the first area corresponds to a difference between a shoulder level and an eye-level of the operator.

13. The system according to claim 10, wherein the extrusion head and the precipitating bath are positioned to be freely accessible by a second operator standing upright in the maintenance area.

14. The system according to claim 1, wherein components of the system through which the endless molded bodies pass from the extrusion head to the means for bundling are spaced apart from each other by not more than 80 cm.

15. The system according to claim 14, wherein the components are spaced apart from each other by not more than 50 cm.

16. The system according to claim 1, further comprising a plurality of extrusion stations spaced apart from each other along the first area, wherein each extrusion station is provided with spinning means.

17. The system according to claim 16, wherein the system comprises substantially identical extrusion stations in a modular fashion.

18. The system according to claim 1, wherein the air gap is adjustable via a handle arranged above the precipitating bath and freely accessible by a second operator standing in the second area.

19. The system according to claim 1, wherein the first area is spaced from the air gap by no greater than 2 m.

20. The system according to claim 1, further comprising a re-directing means formed by the upper edge of the precipitating bath.

21. A system for producing endless molded bodies from a molding compound, the system comprising:

spinning means having an air gap through which molding compound passes following extrusion;

an area arranged in front of the spinning means and accessible by a human operator in a standing position, wherein the air gap is at an elevation within a central vision range of the human operator having average dimensions of a representative population group standing in the area and looking substantially horizontally toward the spinning means; and a means for bundling by which the endless molded bodies are combined to form a bundle, wherein the means for bundling is positioned to be freely visible in the system in the central vision range of the operator standing in the area and looking in a substantially horizontal direction toward the spinning means.

22. The system according to claim 21, wherein the central vision range extends approximately up to 15° above a horizontal line at an eye-level of the operator standing in the area.

23. The system according to claim 21, wherein the central vision range extends approximately up to 5° above a horizontal line at an eye-level of the operator standing in the area.

24. The system according to claim 21, wherein the central vision range extends approximately up to 15° underneath a horizontal line at an eye-level of the operator standing in the area.

25. The system according to claim 21, further comprising re-directing means by which the endless molded bodies are re-directed in the spinning means, wherein the re-directing means is positioned to be freely visible in the system in the central vision range of the operator standing in the area and looking in a substantially horizontal direction toward the spinning means.

26. The system according to claim 1, wherein the population group is aged between 16 and 60, and is representative of a country or a region of the operating staff.

27. The system according to claim 26, wherein the central vision range of the operator extends approximately up to 15° above and approximately up to 15° underneath a horizontal line extending on an eye-level of the operator.

28. The system according to claim 1, wherein the height defined by the central vision range of the operator is from 135 centimeters to 175 centimeters.

29. The system according to claim 28, wherein the central vision range of the operator extends approximately up to 15° above and approximately up to 15° underneath a horizontal line extending on an eye-level of the operator.

30. The system according to claim 12, wherein the difference in height between the second area and the first area is from about 20 cm to about 40 cm.

31. The system according to claim 1, wherein the precipitating bath comprises an upper edge and wherein the endless molded bodies are deflected by the upper edge.

32. The system according to claim 31, wherein the upper edge comprises a recess.

33. The system according to claim 21, wherein the precipitating bath comprises an upper edge and wherein the endless molded bodies are deflected by the upper edge.

34. The system according to claim 33, wherein the upper edge comprises a recess.

35. A system for producing endless molded bodies from a molding compound, the system comprising:

an extrusion head through which the molding compound is extruded to form endless molded bodies;

a precipitating bath containing a precipitant;

an air gap located between the extrusion head and the precipitating bath; and first area arranged in front of the extrusion head, the precipitating bath, and the air gap; wherein the endless molded bodies are first passed through the air gap and then through the precipitating bath; and a bundling device by which the endless molded bodies are combined to form a bundle, wherein the bundling device is positioned to be freely accessible between the extrusion head and the first area of the system and is arranged outside and above the precipitating bath; and wherein the first area is accessible by an operating staff, the operating staff comprising an operator, and the air gap is positioned to be freely visible at a height defined by a central vision range of the operator standing or walking upright in the first area and looking substantially in a horizontal direction, the operator having average dimension of a representative population group.

36. The system of claim 35, wherein the bundling device is constructed in a substantially roller-shaped fashion.

37. The system of claim 36, wherein the axis of the roller extends against the horizontal line on the eye level of the operator, so that a part of the roller surface faces towards a front of the system.

* * * * *

UNITED STATES PATENT AND TRADEMARK OFFICE

CERTIFICATE OF CORRECTION

PATENT NO. : 7,614,864 B2
APPLICATION NO. : 10/900518
DATED : November 10, 2009
INVENTOR(S) : Zikeli et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 816 days.

Signed and Sealed this

Fourteenth Day of December, 2010

David J. Kappos

David J. Kappos
*Director of the United States Patent and Trademark Office*